US007048429B2

(12) United States Patent
Asami

(10) Patent No.: US 7,048,429 B2
(45) Date of Patent: May 23, 2006

(54) CONCRETE MIXER

(75) Inventor: Kunio Asami, Niigata (JP)

(73) Assignee: Kabushiki Kaisha Asami Seisakusho (JP)

( * ) Notice: Subject to any disclaimer, the term of this patent is extended or adjusted under 35 U.S.C. 154(b) by 177 days.

(21) Appl. No.: 10/485,658

(22) PCT Filed: Aug. 2, 2002

(86) PCT No.: PCT/JP02/07885

§ 371 (c)(1),
(2), (4) Date: Feb. 3, 2004

(87) PCT Pub. No.: WO03/013814

PCT Pub. Date: Feb. 20, 2003

(65) Prior Publication Data

US 2004/0179423 A1 Sep. 16, 2004

(30) Foreign Application Priority Data

Aug. 3, 2001 (JP) ..... 2001-236808
Jul. 30, 2002 (JP) ..... 2002-221365

(51) Int. Cl.
*B28C 5/26* (2006.01)
*B28C 5/48* (2006.01)

(52) U.S. Cl. ..... 366/57; 366/62; 366/111; 366/114

(58) Field of Classification Search ..... 366/53–67, 366/110, 111, 113–115, 286
See application file for complete search history.

(56) References Cited

U.S. PATENT DOCUMENTS 83,211 A * 10/1868 Symons et al. ..... 124/21
2,724,582 A * 11/1955 Huff ..... 366/111
3,655,168 A * 4/1972 Lord ..... 366/60
4,786,179 A * 11/1988 Kaminski ..... 366/2
5,908,240 A * 6/1999 Hood ..... 366/18

FOREIGN PATENT DOCUMENTS

JP 59-152806 A1 8/1984
JP 01-011446 Y2 4/1989
JP 05-068861 A1 3/1993
JP 08-294912 A1 11/1996
JP 09-109136 A1 4/1997
JP 11-114394 A1 4/1999

* cited by examiner

*Primary Examiner*—David Sorkin
(74) *Attorney, Agent, or Firm*—Akerman Senterfitt

(57) ABSTRACT

In order to make good-quality concrete, a concrete mixer for mixing materials of concrete by rotation is provided so as to enhance fluidity of a mixture. A mounting frame 7 supporting a drum 2 of a concrete mixer 1 fixes a vibration device 25 via a mounting plate 21. A pair of arms 20 is integrally formed with both ends of the mounting plate 21, while rollers 24 rotationally supported by one ends of the arms 20 respectively contact the outer periphery of the drum 2. A vibration of the vibration device 25 is transmitted from the rollers 24 rotatably supported by the pair of arms 20 to the drum 2, so that the drum 2 vibrates while it rotates. Accordingly, a mixture is liquefied, and thus concrete having a good quality can be produced.

3 Claims, 5 Drawing Sheets

CONCRETE MIXER

BACKGROUND OF THE INVENTION

1. Field of the Invention

The present invention relates to a concrete mixer which produces ready-mixed concrete by mixing materials such as gravel, aggregate, cement, water, admixture and so on.

2. Description of the Related Art

Conventionally, concrete is produced by: compounding water, cement, aggregate, various kinds of admixtures; and mixing these materials using a concrete mixer, while coarse aggregate such as gravel, crushed stones and sand, as well as fine aggregate such as fine sand are generally used as aggregate for the production of the above-described kind of concrete.

Meanwhile, since industrial wastes such as sludge, stone dust, refuse incineration ash, ceramic dust, glass dust, soil developed from a construction field and partially including waste paper or waste pulp are mostly disposed for land-filling, lack of land-fill sites as well as environmental pollution due to illegal dumping has become more serious than ever, and thus disposing the industrial wastes has become a serious problem in recent years. On the contrary, collecting sand from a river or a mountain, the sand being used as aggregate of concrete, has been subject to restrictions from the standpoints of nature-protection and environment conservation, while sea sand is not suitable for aggregate of concrete because sodium included therein causes concrete-deterioration. In this connection, attempts to use the ones which have conventionally had no alternative but to be disposed, such as sludge, stone dust, refuse incineration ash, ceramic dust, glass dust, soil developed from a construction field and partially including waste paper or waste pulp, as aggregate have been made, but these materials generally have large percentages of moisture content and large percentages of water absorption, and thus resistances thereof become large when agitated and mixed with the cement. This makes effective agitation and mixing difficult.

The present invention has been made to solve the above problem, and it is accordingly an object thereof to provide a concrete mixer which can enhance fluidities of raw materials of concrete when mixing the raw materials for a concrete structure so as to mix a mixture thereof reliably and effectively.

SUMMARY OF THE INVENTION

In order to attain the above object, a concrete mixer as set forth in a first aspect rotatably supports a drum to a mounting frame and rotates the drum while using a driving motor so as to mix various kinds of materials in the drum, wherein: a vibration device is fixed to at least the mounting frame; and a vibration transmitting means for transmitting a vibration of the vibration device to the drum is provided on the mounting frame.

By employing this structure, the drum is rotated by the driving motor when mixing ready-made concrete. As water spreads inside the drum during the mixing, the mixture will be turned in a viscous state. Especially when sludge, stone dust, refuse incineration ash, ceramic dust, glass dust, soil developed from a construction field and partially including waste paper or waste pulp are used as aggregate, the mixture will then have larger viscosity but it is liquefied by the vibration transmitting means which transmits a vibration from the vibration device to the drum so as to vibrate the drum, so that ready-mixed concrete having a good quality can be produced.

In the concrete mixer as set forth in aspect 2, the drum has a cylindrical shape having an open end and a bottom portion, the drum including a plurality of agitating blades thereinside, the mounting frame has a bearing on central part thereof in order to rotatably support a rotation shaft, the rotation shaft being provided on the bottom portion of the drum in a protruding manner and the vibration device is fixed adjacent to the bearing.

By employing the structure described in a second aspect, the drum, located on the center of the mounting frame, rotates around the rotation shaft, while the materials in the drum are mixed by the agitating blades. At this moment, the vibration from the vibration device is transmitted to the mounting frame or to the drum at a portion such as the rotation shaft, and then further transmitted through the vibration transmitting means to the drum, while the vibration device is fixed to the center of the mounting frame, so that the vibration of the vibration device is effectively transmitted to the mounting frame entirely, thereby enabling the vibration to be transmitted from the mounting frame to the drum effectively.

In the concrete mixer as set forth in a third aspect, the vibration transmitting means comprises: a pair of arms integrally protruding from the mounting frame; and a rotation member rotatably supported by respective one end of the pair of arms, the rotation members contacting the drum.

By employing this structure, the vibration from the vibration device is transmitted to the mounting frame and the pair of arms integrally protruding therefrom, and then transmitted to the drum effectively through the rotation member rotatably supported by each arm.

In the concrete mixer as set forth in a fourth aspect, the pair of arms is provided on both ends of a mounting plate, the mounting plate being stacked on the mounting frame and being fixed thereon so that the pair of arms is arranged symmetrically relative to the vibration device while each of the rotation members is rotationally supported by each of the arms.

By employing this structure described in the fourth aspect, the vibration device for applying the vibration to the concrete mixer is fixed to the center of the mounting frame so as to be adjacent to the rotation shaft which is the center of rotation of the drum, the vibration of the vibration device is thus transmitted to the mounting frame entirely, while the pair of arms is arranged symmetrically relative to the vibration device as a center thereof, so that the vibration is transmitted to each of arms in an even manner. Accordingly, the rotating drum can be vibrated effectively.

The concrete mixer as set forth in a fifth aspect, fixes a drum to a mounting frame and mixes various kinds of materials in the drum while rotating agitating blades provided inside the drum, wherein the drum is equipped with a vibration device.

By employing this structure described in the fifth aspect, the agitating blades are rotated when mixing ready-made concrete. As water spreads inside the drum while mixing, the mixture will be turned in a viscous state, especially, when sludge, stone dust, refuse incineration ash, ceramic dust, glass dust, soil developed from a construction field and partially including waste paper or waste pulp are used as aggregate, the mixture has large viscosity but it is liquefied by vibrating the drum while using the vibration device, and thus ready-mixed concrete having a good quality can be produced.

The concrete mixer as set forth in a sixth aspect, further comprises an elevation driving means for moving said agitating blades up and down.

By employing this structure described in the sixth aspect, in the concrete mixer according to the fifth aspect, the agitating blades are moved up after mixing the materials. This makes it possible to easily remove the mixture from the drum and put the materials into the drum again. After the materials are put into the drum, the agitating blades are moved down, and thus the materials in the drum can be agitated.

In the concrete mixer as set forth in a seventh aspect, the mounting frame comprises a slope member for fixing the drum and the agitating blades.

In the concrete mixer of the seventh aspect, the mixture moves up by the rotation of the agitating blades and falls down due to its weight since the drum and the agitating blades are inclined, while this flow of the mixture agitates the mixture itself.

In the concrete mixer as set forth in an eighth aspect, the drum is rotatably fixed to the slope member.

The concrete mixer of the eighth aspect agitates the materials with the agitating blades and then moves the agitating blades upward, thereby enabling the drum to rotate in the vertical direction.

In the concrete mixer as set forth in a ninth aspect, the drum has a cylindrical shape having an open end and a curved bottom portion while the vibration device is provided on the bottom portion of the drum.

Thus, the materials supplied to the drum are collected in the curved bottom portion of the drum, thus making it possible to agitate the collected materials effectively by the agitating blades.

DETAILED DESCRIPTION OF THE PREFERRED EMBODIMENTS

Figure 1:
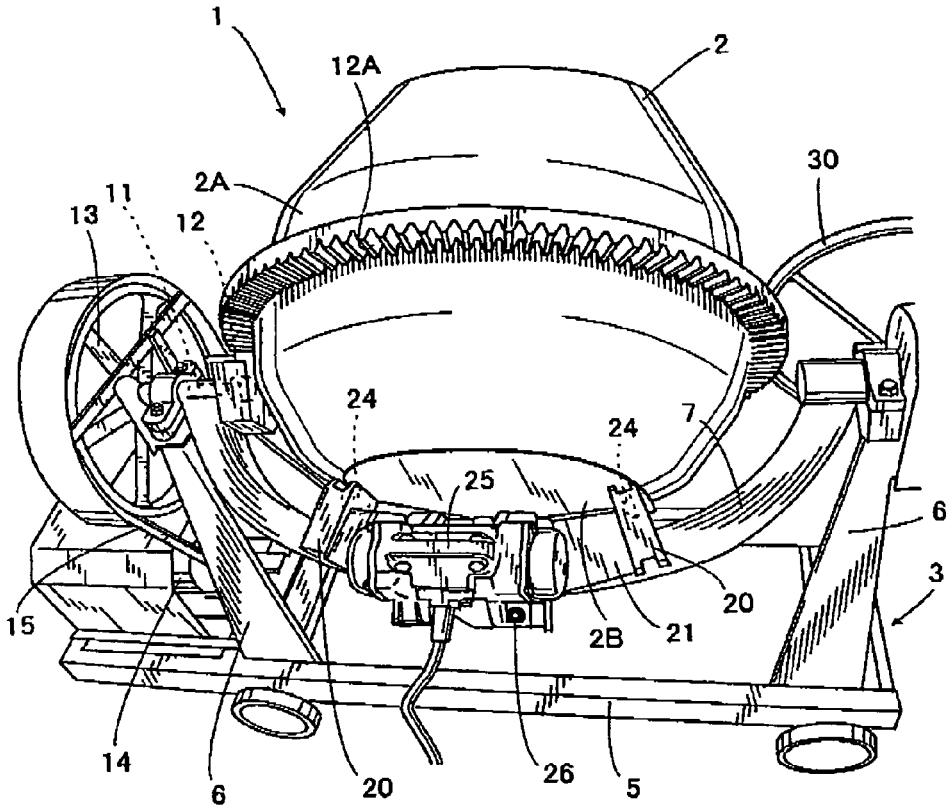
FIG. 1 is a perspective view showing a concrete mixer according to a first embodiment of the present invention.
Figure 2:
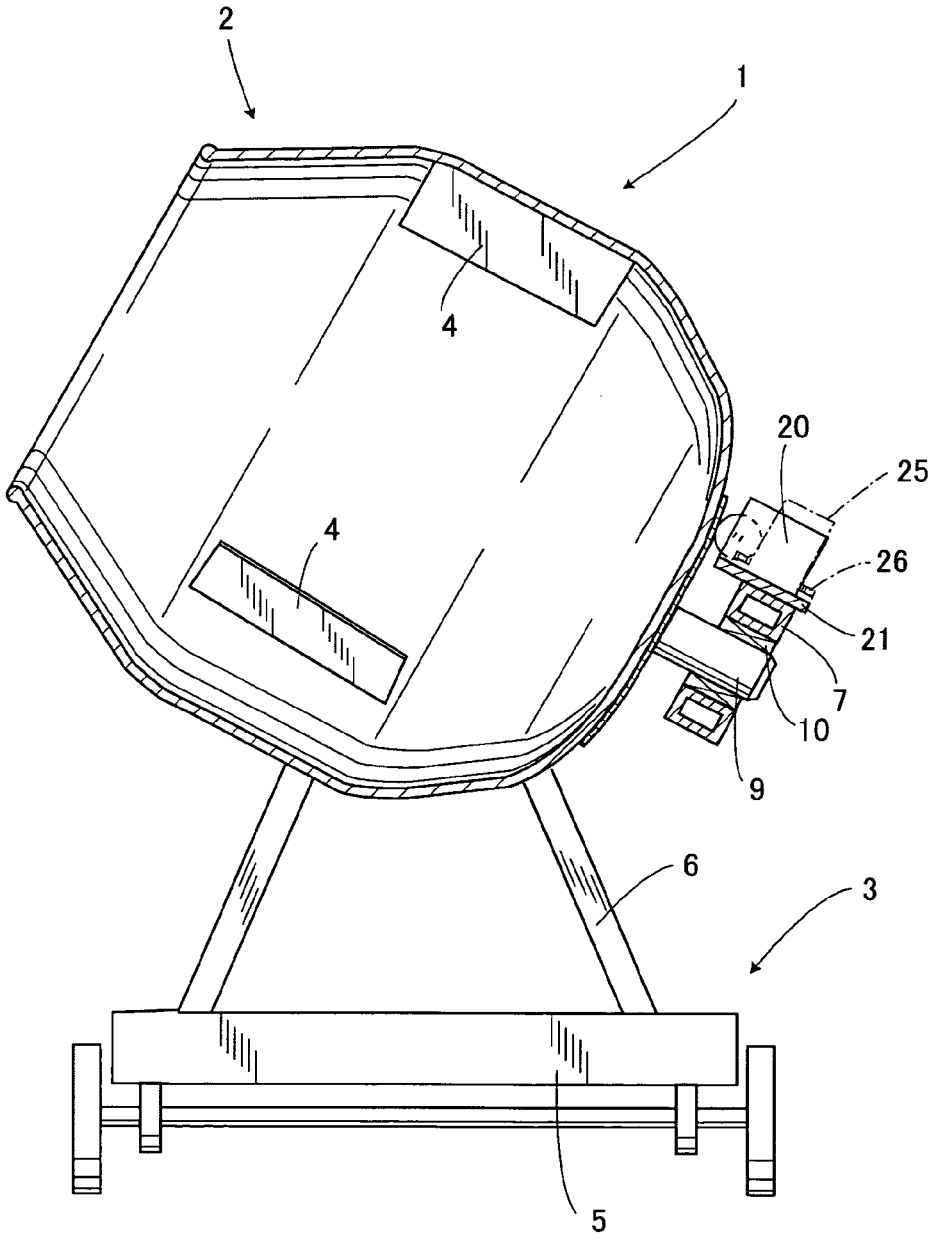
FIG. 2 is a cross sectional view showing the concrete mixer of FIG. 1.
Figure 3:
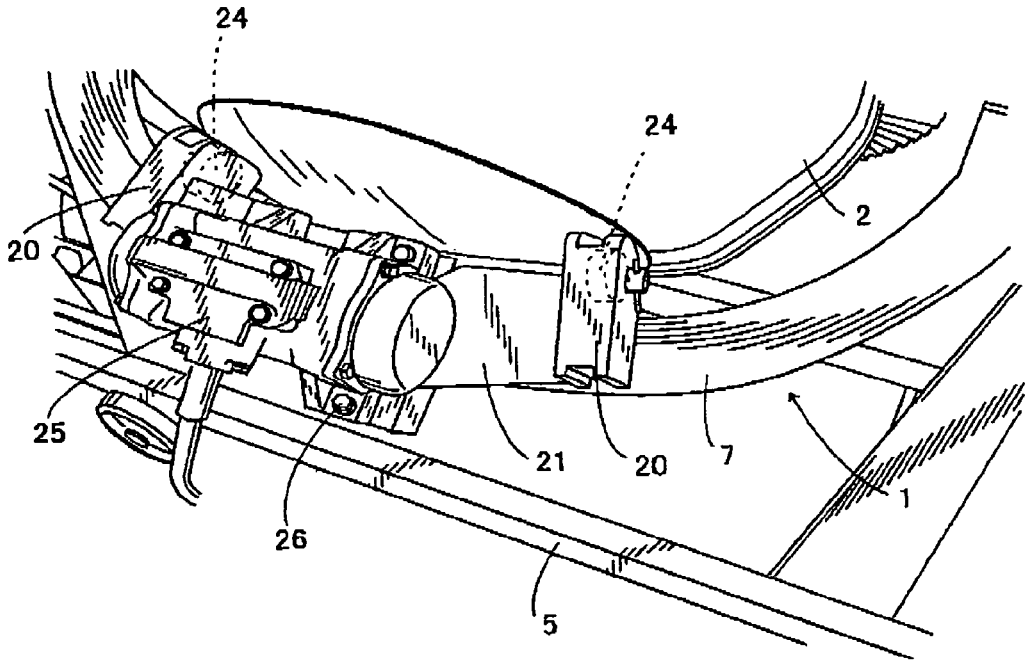
FIG. 3 is a perspective view showing a principal part adjacent to a vibration device included in the concrete mixer shown in FIG. 1.

Preferred embodiments of the present invention will now be described with reference to the accompanying drawings. FIGS. 1 to 3 show a first embodiment of the present invention, while in those figures, reference number 1 denotes a rotational type concrete mixer which produces concrete by mixing materials such as gravel, aggregate, cement, water, admixture and so on, the concrete mixer 1 comprising: a drum 2 having a front surface formed an opening in order to put in the materials; and a frame 3 for supporting the drum 2. A main body portion 2A of the drum 2 is formed in a tapered shape expanding toward a bottom portion 2B of the drum 2, while the drum 2 curves smoothly from the bottom part of the main body portion 2A to the bottom portion 2B. Moreover, inside the drum 2, a plurality of agitating blades 4 is fixed on.

The frame 3 comprises: a movable frame-shaped base frame 5 having a plurality of casters; a pair of supporting frames 6, 6 arranged on the base frame 5 in a standing condition; and a mounting frame 7 constructed between the pair of supporting frames 6, 6. The mounting frame 7 rotationally mounts the drum 2, and shaped so as to curve along the body portion 2A to the bottom portion 2B. Both ends of the mounting frame 7 are rotatably supported by the pair of supporting frames 6, 6, and thus the mounting frame 7 is equipped between the pair of supporting frames 6, 6. Moreover, on the center of the bottom portion 2B of the drum 2, a rotation shaft 9 is integrally provided in a protruding manner while a bearing 10 fixed on the center part of the mounting frame 7 mounts the rotation shaft 9 on a pivot. Accordingly, the drum 2 is rotationally supported by the mounting frame 7. A drive shaft 11 penetrates one end of the mounting frame 7, while a gear 12 fixed to one end of the drive shaft 11 engages a gear 12A fixed on the outer periphery of the body portion 2A of the drum 2. A pulley 13 fixed to the other end of the drive shaft 11 is tightened with a driving motor 4 by a belt 15, a rotation of the driving motor 14 is transmitted to the drive shaft 11 via the belt 15 and the pulley 13, while the drum 2 rotatably supported by the mounting frame 7 rotates since the gear 12 fixed to the drive shaft 11 engages with the gear 12A fixed to the outer periphery of the drum 2.

A mounting plate 21 having a pair of arms 20, 20 on both ends thereof is stacked on the upper surface of the central part of the mounting frame 7 and firmly fixed to the mounting frame 7 by, for example, welding. A vibration device 25 such as a vibrator is fixed to the mounting plate 21 by a plurality of bolts 26, etc. On the front end of the mounting plate 21 fixing the vibration device 25, rollers 24 made from a metal are rotationally supported as a rotation member. The rollers 24 are provided symmetrically relative to the rotation shaft 9, which is the rotational axis of the drum 2, as a center thereof. The drum 2 rotates while contacting the rollers 24 consistently, and a vibration from the vibration device 25 is transmitted via the plurality of the rollers 24. In other words, the protruding arms 20, 20 provided on the both ends of the mounting plate 21 fixing the vibration device 25, and the rollers 24 rotatably supported by the arms 20, 20 comprise a vibration transmitting means in this embodiment. The base frame 5, the pair of supporting frames 6 and the mounting frame 7 included in the frame 3 respectively, the mounting plate 21 fixed to the mounting frame 7, the right-and-left arms 20, 20, the rollers 24, the drum 2 are made from a metal which is transmittable of the vibration, while the vibration from the vibration device 25 is transmitted to the drum 2 via the mounting frame 7 fixing the vibration device 25, the plurality of rollers 24 rotatably provided on the front end of the mounting frame 7. Meanwhile, a reference number 30 in FIG. 1 denotes a handle provided on one of the supporting frames 6, while the concrete mixer 1 employs a structure such that the mounting frame 7 can be rotated by rotating the handle 30 in order to adjust the angle of the drum 2.

In the concrete mixer 1 employing the above-explained structure according to this embodiment, the drive shaft 11 is rotated by the driving motor 14 through the belt 15 and the pulley 13 so as to rotate the drum 2 rotatably supported by the mounting frame 7 when mixing concrete. By activating the vibration device 25, a vibration generated therefrom is transmitted to the mounting plate 21 fixed to the mounting frame 7, the pair of arms 20, 20 integrally formed with the both ends of the mounting frame 7 and the rollers 24, 24 rotatably supported by the arms 20, 20 respectively, and thus the vibration having a high-frequency is then transmitted to the drum 2 from the rollers 24, 24. Predetermined amount of gravel, aggregate, cement, water, and admixture are sequentially put into the drum 2, then mixed by the plurality of agitating blades 4.

As water spreads inside the drum 2 while mixing, the mixture will be turned in a viscous state, and thus a load against the plurality of agitating blades 4 becomes large. Especially, when sludge, stone dust, refuse incineration ash, ceramic dust, glass dust, soil developed from a construction field and partially including waste paper or waste pulp are used as the aggregate, the mixture has large viscosity but it is liquefied by transmitting the vibration of the vibration device 25 fixed to the mounting frame 7 to the drum 2 via the rollers 24, 24 and applying this high-frequency vibration to the drum 2, ready-mixed concrete having a good quality can be produced accordingly.

As explained above, when the materials of concrete such as water, cement, aggregate and admixture are put into the drum 2 of the concrete mixer 1 and mixed by rotating the concrete mixer 1, the mixture is liquefied so as to enhance fluidity thereof by applying the vibration of the vibration device 25 fixed to the mounting frame 7 to the drum 2. Accordingly, even the ones which have been disposed as industrial wastes, such as sludge, stone dust, refuse incineration ash, ceramic dust, glass dust, soil developing at a construction field and partially including waste paper or waste pulp are used as aggregate, good fluidity thereof can be obtained thus it is not necessary to add an expensive mixing additive agent such as an expensive and high-performance AE water reducing agent. Moreover, since a ratio of water relative to cement can be decreased, the amount of cement for producing a concrete structure of the same strength can be reduced, and thus a production cost of concrete structure can be reduced. Further, since the vibration device 25 applying the vibration to the concrete mixer 1 is fixed to the center part of the mounting frame 7 so as to adjoin the bearing 10 of the rotation shaft 9 which is the center of rotation, the vibration from the vibration device 25 can be efficiently transmitted to the mounting frame 7 entirely and the drum 2 via the rotation shaft 9. Even further, since the pair of arms 20, 20 is integrally formed with the both ends of the mounting plate 21 fixing the vibration device 25, while the rollers 24, 24 rotatably supported by the pair of arms 20, 20 contact the drum 2, the vibration can be always transmitted to the rotating drum 2 via the rollers 24, 24 and thus the vibration can be transmitted to the drum 2 effectively without being damped.

Figure 4:
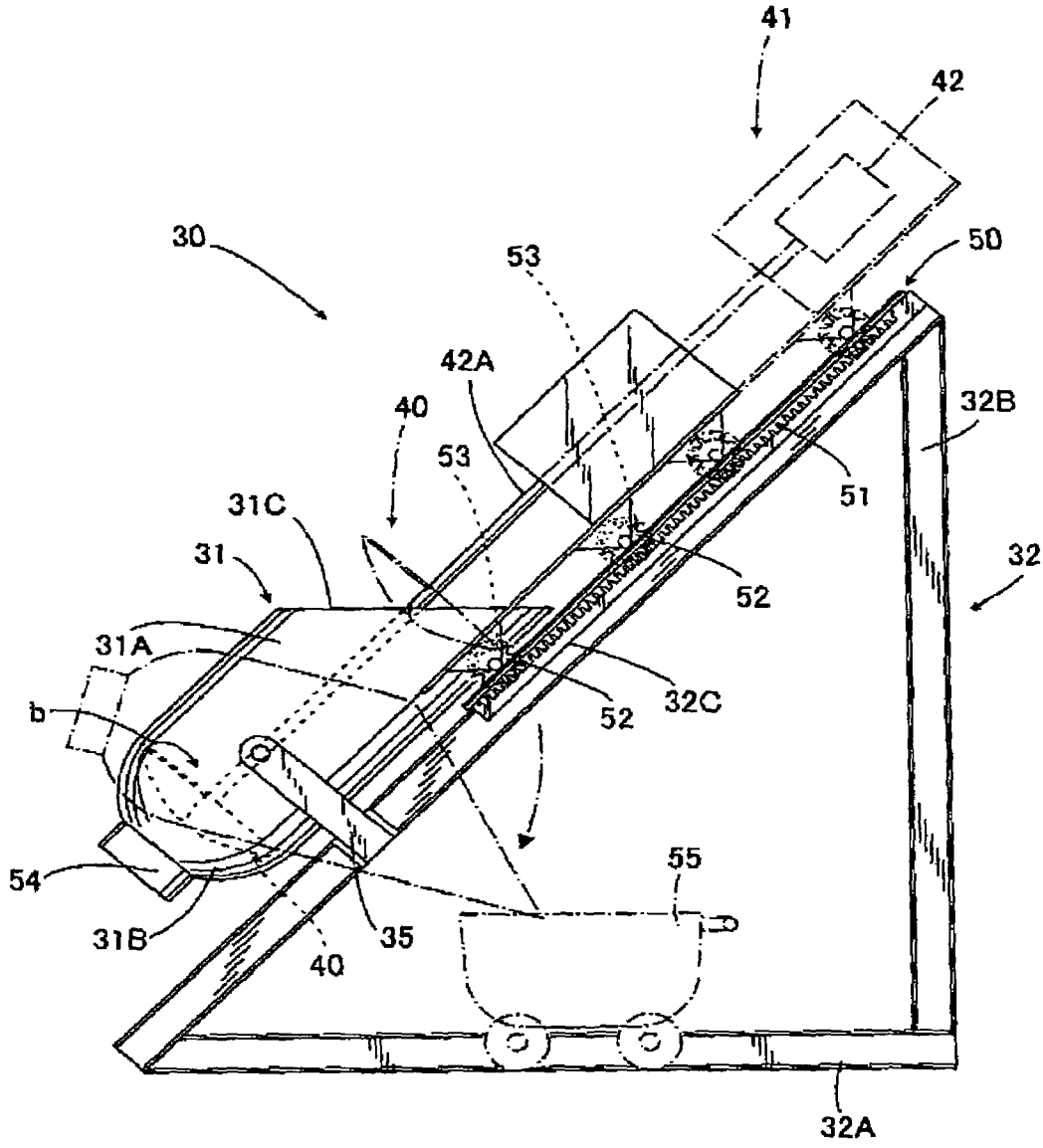
FIG. 4 is a front view showing a concrete mixer according to a second embodiment of the present invention.
Figure 5:
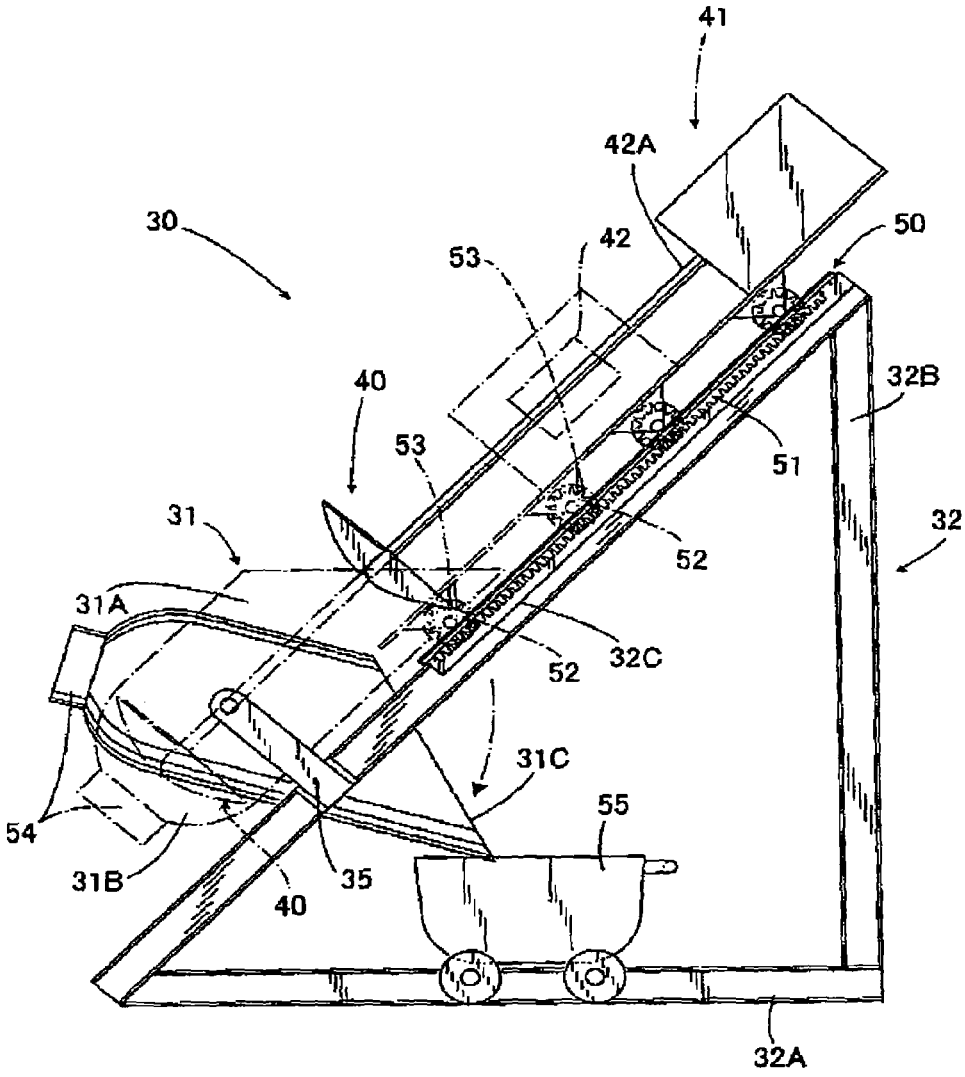
FIG. 5 is a front view of the concrete mixer of FIG. 4 showing a state where it discharges materials from a drum.

FIGS. 4 and 5 show a second embodiment of the present invention, while in those figures, reference number 30 denotes a concrete mixer which produces concrete by mixing materials such as gravel, aggregate, cement, water, admixture and so on, the concrete mixer 30 comprising: a drum 31 having an upper surface formed with an opening in order to put in materials of concrete; and a frame 32 for supporting the drum 31. In this embodiment, a main body portion 31A of the drum 31 has a substantially linear shape, while the drum 31 curves smoothly from the bottom part of the main body portion 31A to a bottom portion 31B.

The frames 32 are connected to each other via connecting members (not shown) so as to be shaped in a frame in its entirety. The frame 32 comprises: a parallel member 32A fixed on a plane for installing thereof; a perpendicular member 32B arranged on one end of the parallel member 32A in a standing condition; and a slope member 32C hanged from the perpendicular member 32B to the parallel member 32A. A pair of mounting arms 35 for rotatably supporting the drum 31 is fixed on the slope member 32C, while front ends thereof mount the drum 31 so as to freely rotate. In this embodiment, the angle of inclination of the slope member 32C is set at around 45 degree, while the drum 31 is fixed to the slope member 32C so as to incline about 45 degree but an opening portion 31C of the drum 31 is formed so as to be parallel.

Reference number 40 denotes agitating blades 40, and reference number 41 denotes a driving unit for driving the agitating blades 40. The driving unit 41 incorporates a driving motor 42 for the agitating blades 40, while the agitating blades 40 are placed to one end of a drive shaft 42A of the driving motor 42. In other words, the drum 2 rotates in the above-explained embodiment, however, the drum 31 does not rotate in this embodiment but the agitating blades 40 in the inside of the drum 31 rotate instead in this embodiment. Furthermore, the agitating blades 40 employ a structure such that it is moved up and down along the slope member 32C of the mounting frame 32 by an elevating unit 50. The elevating unit 50 comprises: a pair of racks 51 fixed to the slope member 32C respectively; a pinion gear 52 provided on the driving unit 41; and a motor 53 for driving the pinion gear 52, while the pair of racks 51, the pinion gears 52, and the motor 53 comprise an elevation driving means. The pinion gear 52 engages the racks 51 and the elevation unit 50 moves up and down while rotating the pinion gear 52 by a motor 53. The concrete mixer 30 employs an un-illustrated structure such that the elevation unit 50 and the slope member 32C of the mounting frame 32 are guided by, for example, a proper guiding mechanism such as one comprising a guide roller and a guide rail, while the elevation unit 50 is stably guided along the slope member 32C.

Meanwhile, reference number 54 in the figures denotes a vibration device, while reference number 55 denotes a bucket for ready-mixed concrete agitated and mixed by the concrete mixer 30.

In the concrete mixer 30 employing the above-explained structure according to this embodiment, the agitating blades 40 are rotated by the driving motor 42 when making ready-made concrete. With the rotation of the agitating blades 40, the vibration device 54 provided on the bottom portion 31B of the drum 31 is activated and the vibration thereof is directly transmitted to the drum 31. Predetermined amount of gravel, aggregate, cement, water, and admixture are sequentially put into the drum 31, then mixed by the plurality of agitating blades 40.

As water spreads inside the drum 31 while mixing, the mixture will be brought in a viscous state, and thus a load against the plurality of agitating blades 40 becomes large. Especially, when sludge, stone dusts, refuse incineration ash, ceramic dust, glass dust, soil arising at a construction field and partially including waste paper or waste pulp are used as the aggregate, the mixture has larger viscosity, but it is liquefied by transmitting the vibration of the vibration device 54 fixed to the bottom portion 31B of the drum 31 to the drum 31 and applying this high-frequency vibration thereto, and thus ready-mixed concrete having good quality can be obtained. Moreover, since the drum 31 and the agitating blades 40 are inclined in this embodiment, the mixture mixed up by the rotation of the agitating blades 40 falls down due to its weight as illustrated by an arrow b in FIG. 4, and thus the mixture can be agitated effectively. Further, since the elevation unit 50 for moving the agitating blades 40 up and down is provided, it is possible to move up the agitating blades 40 after agitating the mixture as shown in FIG. 5. This makes it possible to easily put the materials into the drum 31 and transfer the agitated materials to the bucket 55 by rotating the drum 31 in vertical direction.

As explained above, when the materials of concrete such as water, cement, aggregate and admixture are put into the drum 31 of the concrete mixer 30 and mixed by rotating the concrete mixer 30, the mixture is liquefied so as to enhance fluidity thereof by vibrating the drum 30 while using the vibration device 54 fixed to the bottom portion 31B of the drum 30. Accordingly, even the ones which have been disposed as industrial wastes, such as sludge, stone dust, refuse incineration ash, ceramic dust, glass dust, soil developing at a construction field and partially including waste paper or waste pulp are used as aggregate, good fluidity thereof can be obtained so that it is not necessary to add an expensive mixing additive agent such as an expensive and high-performance AE water reducing agent. Moreover, since a ratio of water relative to cement can be decreased, the amount of cement required for producing a concrete structure of the same strength is also decreased, so that a production cost of the concrete structure can be reduced. Further, since the drum 31 and the agitating blades 40 are inclined, a turbulent flow of the mixture agitated by the agitating blades 40 is generated, and thus the mixture is more effectively agitated. Since the agitating blades 40 are moved up and down by the elevation unit 50, the agitating blades 40 can be moved up after the mixture is agitated, thus making it possible to easily remove the mixture from the drum 31. Especially, the drum 31 is rotationally attached to the mounting frame 32 according to this embodiment, it is thus effective when the mixture agitated by the agitating blades 40 in the drum 30 is transferred to the bucket 55. Even further, by mounting the drum 31 and the agitating blades 40 to the slope member 32C of the mounting frame 32, the mixture in the drum 31 moves up by the rotation of the agitating blades 40 and partially falls down due to its weight, while this flow of the mixture agitates the mixture itself, and thus it is possible to agitate the mixture effectively.

The above-described embodiments are intended to illustrate the present invention, not to limit the scope of the present invention, and various embodiments and changes may be made thereonto without departing from the broad spirit and scope of the invention. For example, whilst the structure of the single-acting type concrete mixer is explained in the above embodiments, it may be a double-acting type concrete mixer. Further, the shape of the mounting frame supporting the drum and the number of the rollers contacting the drum are not limited to those of the above embodiments. Still further, whilst the vibration device is provided on the bottom portion of the drum as an example in the second embodiment, it may be provided on the body portion of the drum.

What is claimed is:

1. A concrete mixer rotatably supporting a drum to a mounting frame and rotating said drum while using a driving motor so as to mix various kinds of materials in said drum, comprising:

a vibration device fixed to at least said mounting frame; and a vibration transmitting means for transmitting a vibration of said vibration device to said drum is provided on said mounting frame, said vibration transmitting means comprising:

a pair of arms integrally protruding from said mounting frame;

rotation members rotatably supported by ends of said pair of arms respectively, said rotation members contacting said drum, wherein said drum has a cylindrical shape having an open end and a bottom portion, said drum including a plurality of agitating blades inside thereof, wherein said mounting frame has a bearing on a central part thereof in order to rotatably support a rotation shaft, said shaft being provided on the bottom portion of said drum in a protruding manner; and wherein said vibration device is fixed adjacent to said bearing.

2. The concrete mixer according to claim 1, wherein:

said pair of arms is provided on both ends of a mounting plate, said mounting plate being stacked on said mounting frame and being fixed thereon so that said pair of arms is arranged symmetrically relative to said vibration device as a center thereof; and each of said rotation members is rotationally supported by one of said arms.

3. A concrete mixer for fixing a drum to a mounting frame and mixing various kinds of materials in said drum while rotating agitating blades provided inside said drum.

wherein said drum has a cylindrical shape having an open end and a bottom portion;

wherein a vibration device is provided on the bottom portion of said drum;

wherein an elevation driving means is provided for moving said agitating blades up and down;

wherein said mounting frame comprises a slope member for fixing said drum and said agitating blades; and wherein said drum is rotatably fixed to said slope member.

* * * * *